United States Patent [19]

Arai et al.

[11] 4,196,033

[45] Apr. 1, 1980

[54] PROCESS FOR PRODUCING DECORATIVE SHEETS

[75] Inventors: Eisuke Arai, Koganei; Kuniaki Kamei, Kodaira; Kinji Matushima, Tokorozawa; Matsuo Hirakawa, Tokyo, all of Japan

[73] Assignee: Dai Nippon Insatsu Kabushiki Kaisha, Tokyo, Japan

[21] Appl. No.: 883,545

[22] Filed: Mar. 6, 1978

[30] Foreign Application Priority Data

Mar. 8, 1977 [JP] Japan ..... 52/25230
Jul. 29, 1977 [JP] Japan ..... 52/91594

[51] Int. Cl.[2] ..... B05D 5/02

[52] U.S. Cl. ..... 156/196; 156/272; 156/289; 427/258; 427/264; 427/270; 427/271; 427/277

[58] Field of Search ..... 156/58, 59, 234, 237, 156/240, 242, 245, 272, 289, 196; 427/264, 270, 271, 277, 258

[56] References Cited

U.S. PATENT DOCUMENTS 3,554,827 1/1971 Yamagishi ..... 156/85
4,209,831 6/1977 Daunheimer ..... 427/271

FOREIGN PATENT DOCUMENTS 49-121863 11/1974 Japan .

*Primary Examiner*—Caleb Weston
*Attorney, Agent, or Firm*—Kenyon & Kenyon

[57] ABSTRACT

A process for producing decorative sheets which comprises: forming a pattern on a paper for decorative use with an ink containing a vehicle resin; causing the vehicle resin in the pattern to harden on the paper; impregnating the entire paper for decorative use including the pattern with a thermosetting resin to form an impregnated paper wherein a film of still uncured thermosetting resin is formed over the pattern; assembling a laminated structure by so superposing the impregnated paper on a base material that the surface of the paper bearing the pattern will become the outer surface and further placing a planar shaping member on the paper; subjecting the laminated structure to heating and pressing thereby to cause the thermosetting resin at parts other than the pattern to cure, leaving the thermosetting resin on the pattern in still uncured state; and peeling off the planar shaping member, under heat and after the termination of the pressing, thereby to form concavities on and coincident with the pattern in the film of the thermosetting resin by removing the still uncured resin on the pattern due to adhesion of the uncured resin to the planar shaping member thus peeled-off, the vehicle resin in the ink having a releasability from the thermosetting resin, the ink containing a curing-inhibitor for the thermosetting resin. By this process a decorative sheet having a pattern of sharp concavities and convexities coincident with a design pattern containing parts such as vessels in a wood grain pattern can be produced. The decorative sheet thus produced has remarkably improved surface properties such as abrasion resistance and solvent resistance.

32 Claims, 6 Drawing Figures

A

B

PROCESS FOR PRODUCING DECORATIVE SHEETS

BACKGROUND OF THE INVENTION

This invention relates generally to the production of decorative sheets and more particularly to a process for producing decorative sheets having surface figures formed by concavities and convexities matching or coincident with picture patterns and, moreover, having improved properties of their surfaces such as abrasion resistance and solvent resistance.

Heretofore, there have been two groups of methods, broadly divided, of imparting concavities and convexities matching a design pattern to the surface of a thermosetting resin decorative sheet.

The first group is that of physical methods generally referred to as direct embossing methods. Representative examples are the method wherein an embossing plate coinciding with a design pattern is used, and the pattern concavities and convexities are imparted directly onto the decorative sheet with a mold plate press and the method wherein an embossing roll is used for the same purpose. These methods, however, entail considerable expense for the fabrication of the embossing plate or embossing roll. Moreover, the matching of the design pattern of the decorative sheet and the pattern of the concavities and convexities of the embossing plate or embossing roll is difficult, whereby the production time is long, and there has been the problem of cost.

The second group of methods are generally called chemical embossing methods. One method of this group comprises forming a pattern on a paper for resin impregnation with an ink containing a resin polymerization inhibitor, impregnating the paper with a thermosetting resin, causing differences in the curing speeds of the resin disposed on the surface of the decorative sheet, and, by using these differences, forming an embossed pattern on the surface. Another method of this second group comprises forming a pattern on a paper for resin impregnation with an ink containing a substance having a repellent effect with respect to resins and causing the resin on the ink parts to be repelled at the time of coating or impregnation thereby to form an embossed pattern.

These chemical methods are highly advantageous in the matching of the design pattern and the embossed pattern, but in the case of the former, a long time is required for the curing of the resin, and since only volumetric shrinkage of the resin is utilized, a limit is imposed, as a natural result, on the width of the sunken concavities, whereby concavities having any desired width cannot be formed. Furthermore, this method is not very effective with thermosetting resins of the heating and pressing type such as urea resins, melamine resins, and diallyl phthalate resin. On the other hand, it has been found as a result of various experiments relating to the latter method that this method is accompanied by the problem of insufficient embossing effect with resins of the type cured under heating and pressing with only a repellent effect.

With respect to this problem, there is a known method (as disclosed in the specification of Japanese Patent Laid-Open Application No. 121863/1974) which comprises, in the above mentioned chemical methods, superimposing a plastic film on the surface of the impregnated paper bearing the ink design pattern, thereafter curing the resin under heat and pressure, and then removing the plastic film, thereby removing the resin of the still uncured parts adhering to the plastic film, thereby to form concavities.

The method is an excellent method in that the concavities are formed in faithful coincidence with the design pattern. However, as a result of our studies, we have found that problems such as those set forth below still remain even in this method.

(1) Since the vehicle resin of the ink containing a curing inhibitor has not cured or hardened, it lacks solvent resistance against the solvent of the impregnating solution during the impregnation with the thermosetting resin, whereby the curing inhibitor readily undergoes elution. For this reason, it becomes difficult to form the concavities, and even when they are formed, there is a tendency of the resin to remain to some extent in the concavities, and the sharpness of the rims of the concavities thereby decreases.

(2) Since some uncured resin remains in the concavities of the ink pattern, the solvent resistance is deficient. Moreover, in the case where an ordinary non-solvent-resistant ink is used, contact with the solvent impairs not only the still uncured resin but also the ink pattern itself.

(3) Since differences in curing speeds of the surface resin are utilized for forming the concavities, the resin parts at the peripheries of the concavities are also subjected to some lowering of their curing speeds, whereby the surface properties become poor.

SUMMARY OF THE INVENTION

It is an object of this invention to provide an improvement in the above mentioned process for chemical embossing for forming concavities matching or coincident with a design pattern; comprising enhanced removal of the still uncured resin.

More specifically, as a result of our studies, we have found that the cause of the occurrence of the above described problems (1) and (2) is that a curing inhibitor of the impregnation resin is caused to be contained in the ink pattern, and, in order to cause this to permeate effectively into the impregnation resin, an ink of good compatibility with the impregnation resin is used. For this reason, while the curing speed of the resin is effectively lowered, lowering of the separating property of the ink pattern and the impregnation resin and lowering of the solvent resistance of the ink pattern are considered to occur simultaneously.

We have found that, in contrast to this, the inhibition of curing of the impregnating resin is also possible by printing on the base paper with an ink which contains a resin having good releasability relative to the impregnating resin, and which has been caused to contain a curing inhibitor for the impregnating resin, causing the ink resin to once harden or be cured by a treatment such as heating thereby to form a strong pattern surface, and thereafter carrying out impregnation with a surface decoration resin. This invention is based on this finding.

That is, this invention contemplates the forming of a pattern of concavities having excellent surface characteristics by the strengthening of the ink pattern and enhanced interface separation of the pattern surface and the still uncured impregnation resin. In this connection, even if a resin having releasability relative to the impregnation resin is contained in the ink, desirable concavities or concavities with excellent surface characteristics cannot be formed in the case where a curing inhibitor of the impregnation resin is not contained or in the case where hardening of the ink resin is not carried out prior to the application of the impregnation resin.

Accordingly, this invention provides a process for producing decorative sheets which comprises:

(1) forming a pattern on a paper for decorative use with an ink containing a vehicle resin;

(2) causing the vehicle resin in the pattern to harden on the paper;

(3) impregnating the entire paper for decorative use including the pattern with a thermosetting resin to form an impregnated paper wherein a film of still uncured thermosetting resin is formed over the pattern;

(4) assembling a laminated structure by so superposing the impregnated paper on a base material that the surface of the paper bearing the pattern will become the outer surface and further placing a planar shaping member on the paper;

(5) subjecting the laminated structure to heating and pressing thereby to cause the thermosetting resin at parts other than the pattern to cure, leaving the thermosetting resin on the pattern in still uncured state; and (6) peeling off the planar shaping member, under heat and after the termination of the pressing, thereby to form concavities on and coincident with the pattern in the film of the thermosetting resin by removing the still uncured resin on the pattern due to adhesion of the uncured resin to the planar shaping member thus peeled-off, the vehicle resin in the ink having a releasability from the thermosetting resin, the ink containing a curing inhibitor for the thermosetting resin.

A decorative sheet produced in this manner, however, is still accompanied by the above set forth problem (3), that is, a deterioration of the surface characteristics caused by the incompleteness of curing of thermosetting resin at the peripheries of the concavities. In accordance with a preferred mode of practice of this invention, this problem is solved by subjecting the decorative sheet obtained in the above described process to an after-treatment which comprises irradiating the front surface of the decorative sheet with ultraviolet rays or electron beam, reheating the decorative sheet, or subjecting it again to heat and pressure. By this after-treatment, a decorative sheet of even further improved surface physical properties is obtained.

The nature, utility, and further features of this invention will be more clearly apparent from the following detailed description beginning with a consideration of the general aspects of the invention and concluding with specific example of practice illustrating preferred embodiments of the invention and comparison examples.

DETAILED DESCRIPTION

The principle of this invention will first be described with reference to FIGS. 1 through 5.

Figure 1:
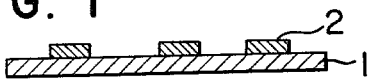
FIGS. 1 through 5 are schematic sectional views taken along planes perpendicular to the plane of a decorative sheet for a description of the principle of the process for producing decorative sheets according to this invention.

A fabric texture pattern, a wood grain pattern, or the like is first printed as a base pattern (not shown) on a sheet of a paper 1 for decorative use as shown in FIG. 1 by using an ordinary ink or paint composition, according to necessity. Then a pattern 2 is laid on the paper 1 only on those parts where the coating film surface of the wood grain pattern, abstract pattern, or the like are to be recessed as concavities with an ink containing a vehicle resin having releasability with respect to the thermosetting resin to be used for impregnation and a curing inhibitor with respect to the impregnating thermosetting resin. Thereafter, the vehicle resin is caused to harden.

Figure 2:
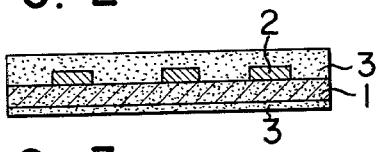
Figure 3:
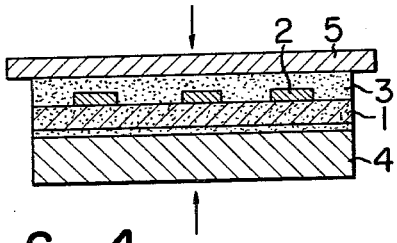

Next, as indicated in FIG. 2, a thermosetting resin 3 is caused to impregnate the printed paper by application thereof as a coating or by dipping and is dried, whereupon an impregnated decorative paper is obtained. In this impregnated decorative paper, not only is a thermosetting resin caused to impregnate the paper 1 for decorative use, but a film 3 of the thermosetting resin is formed also on the pattern 2 and on the reverse face of the paper 1. Then, as indicated in FIG. 3, this impregnated paper is superimposed with the side of the pattern 2 as its outer surface on a substrate or base material 4, and further, on this laminated structure, a planar shaping member such as a metal sheet or a plastic film is laid. Then, by an ordinary procedure, this laminated structure is subjected to heat and to pressure in the arrow direction.

Figure 4:
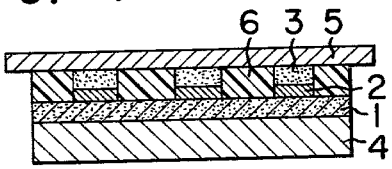

By this heat and pressure forming, the thermosetting resin in parts other than those of the pattern 2 undergoes curing, as indicated in FIG. 4, the thermosetting resin in the parts of the pattern 2 remaining as it is in still uncured state, and cured parts 6 and uncured parts 3 are produced. This may be attributed to the migration of the curing inhibitor contained in the pattern 2 to the film of the thermosetting resin at the parts of the pattern layer, whereby the parts 3 of the thermosetting film above the pattern layer 2 is not cured.

Figure 5:
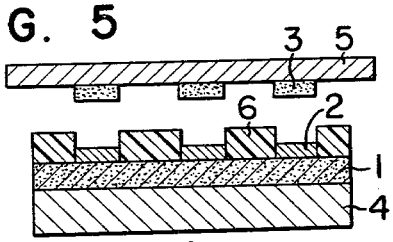

Then, as indicated in FIG. 5, the planar shaping member 5 is peeled off from the resulting laminated sheet, whereupon the resin of the above mentioned uncured parts 3 adhering to the planar shaping member 5 are also peeled off. Since these uncured parts 3 lack affinity relative to the vehicle resin in the pattern 2, they are readily peeled off without any portion thereof remaining on the pattern 2. Furthermore, since these parts are in the still uncured state, they are in a state wherein they very readily adhere to the planar shaping member as a result of heat and pressure.

In this manner, a decorative sheet A having a concave-convex pattern matching the pattern 2 is obtained. In this decorative sheet A, since any uncured layer of the thermosetting resin does not remain in the concave parts, the pattern 2 is exposed, but the sheet has a great surface durability because the above mentioned vehicle resin in the pattern 2 has hardened.

The materials and other particulars of the various parts of the decorative sheet produced in accordance with this invention will now be considered in greater detail.

For the paper 1 for decorative use, in addition to materials ordinarily called papers such as a titanium paper, tissue paper, and kraft paper, cotton fabrics, fabrics of other materials such as glass and sheet-form materials comprising aggregates of fine fibers such as nonwoven fabric can be used. A suitable weight per unit area of this paper 1 is in the range of from 20 to 500 grams/square meter.

As described above, a base pattern, if desired, and an ink pattern 2 of the parts to be sunk as concavities are applied, and thereafter the paper is impregnated with a thermosetting resin 3. Examples of suitable resins which can be used for this thermosetting resin are: one or more thermosetting resins of the radical addition polymerization type, that is, the type wherein the curing or thermosetting of the resin proceeds by addition polymerization, such as polyallyl ester resins such as diallyl phthalate, diallyl maleate, and triallyl cyanurate and unsaturated polyester resins; and prepolymers of these resins.

The term "unsaturated polyester resin" as used herein means a mixture obtained by dissolving an unsaturated polyester in reactive monomers having an ethylenically unsaturated bond such as styrene, divinylbenzene and vinyl acetate. The unsaturated polyester comprises a product obtained by esterifying unsaturated acids such as maleic acid, fumaric acid and itaconic acid or anhydride thereof with glycols such as ethylene glycol, diethylene glycol, propylene glycol and butane diol.

Other examples are thermosetting resin mixtures of the radical addition polymerization type comprising the above enumerated thermosetting resins of the radical addition polymerization type as predominant components and thermosetting resins of the addition-condensation type, that is, the type wherein the curing proceeds by repetition of addition and condensation, such as melamine resins, urea resins, acetoguanamine resins, benzoguanamine resins, and the like and prepolymers thereof admixed in a quantity of the order of 10 to 40 percent by weight in the resin.

Furthermore, it is also possible to use: one or more thermosetting resins of the addition-condensation type such as the above enumerated melamine resins, urea resins, acetoguanamine resins, and benzoguanamine resins; prepolymers of these resins; and thermosetting resin mixtures of the addition-condensation type comprising these resins used as predominant components and thermosetting resins of the radical addition polymerization type such as polyallyl ester resins and unsaturated polyester resins and prepolymers of these resins admixed in a quantity of the order of 10 to 40 percent by weight in the resin.

When used according to this invention, these thermosetting resins are used in the form of impregnating liquor of solvent type or emulsion type comprising, for example, from 20 to 70 percent by weight of the resin and from 30 to 70 percent by weight of a solvent or a dispersant, to which a curing promoter is added, according to necessity, in a quantity of 1 to 5 percent by weight. Also, according to necessity, known additives such as a releasing agent such as lauric acid, a coloring agent such as a dye or a pigment, a plasticizer, a stabilizer, a wax or grease, a drying agent, an auxiliary drying agent, a thickener, a dispersing agent, and a filler are added. The impregnating liquor thus prepared is used for impregnating the paper for decorative use.

It has been found that, by adding as a filler an inorganic substance in powder form which is incompatible with both the above mentioned resin and the solvent to the resin in a quantity of 1 to 6 percent by weight of the total quantity of the above mentioned resin liquor, the still uncured thermosetting resin after the heat and pressure forming readily adheres to the planar shaping member, and the addition of the inorganic substance powder is desirable to effect. This may be attributed to a further decrease in the cohesion of the uncured thermosetting resin due to the addition of the inorganic substance powder. This may be further attributed, in the case where the planar shaping member is a metal sheet, to an improvement in the adhesiveness of the uncured thermosetting resin relative to the metal plate since the affinity of the inorganic substance powder relative to a metal plate is good.

Examples of inorganic substances in powder form to be added for this purpose are: inorganic substance powders ordinarily used as fillers or extenders including; metal oxides such as silica, alumina, and titanium oxide; metal salts such as calcium carbonate and magnesium carbonate; and metal powders such as aluminium powder. The average particle size of this powder is preferably from 0.1 to 50 μm.

In this case, if the quantity of the impregnating resin in the impregnated paper is from 30 to 200 percent, in terms of solid content, of the weight of the paper for decorative use, the objects of this invention can be achieved, but an impregnating resin quantity of from 70 to 160 percent is preferable. As a result, not only is the paper for decorative use impregnated with the thermosetting resin, but a dried film of the resin of a thickness ordinarily of the order of 1 to 500 μm is formed on the ink pattern 2.

Prior to the impregnation with the thermosetting resin, a base pattern such as a fabric weave pattern or a wood grain pattern can be applied onto the paper for decorative use. Furthermore, a pattern of parts to be sunken concavities corresponding to timber tracheids, vessels, and the like can be applied. These patterns can be applied by an ordinary printing method such as letterpress printing, offset printing, gravure printing, or screen process printing, by drawing by hand, or by a method such as painting.

For the ink or paint composition for forming the base pattern, known materials can be used. For example, the ink or paint composition can be prepared by adding a coloring agent such as a dye or pigment to a vehicle for inks or paints, further adding as desired any of known additives such as plasticizers, stabilizers, waxes, greases, drying agents, auxiliary drying agents, hardening agents, thickeners, dispersing agents, and fillers, and amply kneading the resulting composition with a liquid such as a solvent or a diluent.

For the vehicle of the above mentioned ink or paint composition, use can be made of any of known substances such as, for example: fats and oils such as linseed oil, soybean oil, and synthetic drying oils; natural resins and processed resins such as rosin, copal, dammar, hardened rosin, rosin esters, and polymerized rosin; synthetic resins such as rosin-modified phenol resins, 100-% phenol resins, maleic resins, alkyd resins, petroleum resins, vinyl resins, acrylic resins, polyamide resins, epoxy resins, and aminoalkyd resins; cellulose derivatives such as nitrocellulose and ethylcellulose; rubber derivatives such as rubber chloride and cyclized rubber; and other substances such as glue, casein, dextrin, and zein.

The composition used for providing the pattern 2 at which concavities are to be formed, includes from 5 to 50 percent of a vehicle resin, from 20 to 70 percent of a solvent, and from 3 to 60 percent of a curing inhibitor of the impregnating thermosetting resin, all percentages being by weight. In addition, depending on the necessity, up to 50 percent by weight of a pigment or dye and any of the various additives enumerated above in connection with the composition for forming the base pattern can be added.

It is necessary that the vehicle resin has a releasability with respect to the thermosetting resin 3. Herein, the term "releasability" means that the adhesion between the hardened vehicle resin and the uncured thermosetting resin is smaller than that between the uncured thermosetting resin and the planar shaping member and also is smaller than the cohesive force of the uncured thermosetting resin.

This condition is satisfied for example, by the use, as the vehicle resin, of a solvent resistant thermoplastic resin which is not soluble in the solvent for the thermosetting resin for impregnation, and which is typically represented by fluorine-containing resins such as polytetrafluoroethylene, polychlorotrifluoroethylene, and polyvinylidene fluoride or a thermosetting resin of a type different from that of the above mentioned thermosetting resin for impregnation. Suitable examples of the latter are thermosetting resins of the condensation type, that is, the type wherein the curing of the resin proceeds by condensation, and which includes the addition-condensation type. Examples of these resins are melamine resins, urea resins, silicone resins, and phenolic resins in the case where a resin of the radical addition polymerization type is used for the thermosetting resin for impregnation. Furthermore, in the case where a thermosetting resin of the condensation type is used for the thermosetting resin for impregnation, thermosetting resins of the addition polymerization type such as diallyl phthalate, unsaturated polyesters, urethane resins, amine-cure type epoxy resins using amines as a curing promotor, and addition polymerization type silicone resins into which an ethylenic unsaturated group has been introduced, may be used as the vehicle resin.

By adding to these resins, modified product of these resins with cellulose, an alcohol, an alkyd, or the like partly, for example, in a quantity of from 5 to 30 percent by weight with respect to the vehicle resin, or from 10 to 60 percent by weight of a thermoplastic resin such as cellulose, acrylic resins, and polyvinyl chlorides, desirable effects can be obtained. More specifically, for example, an improvement in the ink printability is attained, and an easing of the conditions for hardening of the vehicle resin, carried out after application of the ink, such as a shortening of the time and lowering of the temperature is afforded, without lowering of the performance of the ink film.

Examples of the solvent or dispersing agent in the ink are: aromatic hydrocarbons such as toluene and xylene; aliphatic alcohols such as isopropyl alcohol, ethyl alcohol and methyl alcohol;

esters such as ethylacetate and butyl acetate; ketones such as acetone, methylethyl ketone and methylisobutyl ketone;

ethers such as ethylene glycol monomethyl ether, dioxane, and tetrahydrofuran;

lactones such as γ-propiolactone and γ-butyrolactone; and amides such as dimethylformamide and dimethylacetamide. These solvents or dispersing agents are used singly or as mixtures thereof. In addition, water can be used as a dispersing medium.

Incidentally, these solvents or dispersing agents may also be used for preparing the impregnating liquor mentioned above.

For the curing inhibitor to be contained in the ink, in the case where a thermosetting resin for impregnation of radical addition polymerization type is used, any inhibitor which inhibits the radical addition polymerization can be used. Examples of suitable curing inhibitors are: quinones such as p-benzoquinone and naphthoquinone; hydroquinones such as hydroquinone; p-tertiary butyl catechol; phenols such as ditertiary butyl paracresol and hydroquinone monomethyl ether; organic and inorganic copper salts such as copper naphthenate; hydrozine salts such as phenylhydrazine hydrochloride; and quaternary ammonium salts such as trimethylbenzylammonium chloride. These curing inhibitors can be used singly or as mixtures thereof.

Furthermore, for the curing inhibitor in the case where a thermosetting resin of the addition-condensation type is used for the thermosetting resin for impregnation, strongly basic substances including hydroxides, oxides, etc., of alkali metals and alkaline earth metals can be used. Specific examples of the strongly basic substances are sodium hydroxide, potassium hydroxide, calcium oxide, and calcium hydroxide. These curing inhibitors can be added into the ink directly or in the form of microcapsules thereof by using as the microencapsulating agent such as a thermoplastic resin which will soften at a temperature of 100°–200° during the heat and pressure forming. While it is also possible to use any of the above described strongly basic substances by itself, by using a blowing agent active under the conditions of the heat and pressure forming together with the strongly basic substance, an even more effective inhibiting action can be obtained. Examples of suitable blowing agents are sodium hydrogencarbonate, sodium borohydride, azobisisobutyronitrile, benzene sulfonyl hydrazide, and p-toluenesulfonyl hydrazide. These blowing agents can be used singly or as mixtures thereof in a quantity of the order of 10 to 50 percent by weight relative to the curing inhibitor.

The curing inhibitor content within the ink composition is from 3 to 60 percent by weight, particularly preferably from 5 to 40 percent by weight. It has been found that with a content of less than 3 percent, the inhibiting action on the thermosetting resin for impregnation is insufficient, whereby the cohesive force between the resin parts which have been affected by and the resin parts which have not been affected by the inhibitor in the thermosetting resin is great, and it is not possible to obtain the concave-convex shape with only the releasability with respect to the vehicle resin and the force of adhesion to the planar forming member of the latter resin parts. On the other hand, if the curing inhibitor content is greater than 60 percent by weight, it will affect the hardening performance of the vehicle resin, whereby the strength of the ink surface film will weaken, and, at the same time, the peeling separation from the thermosetting resin will also become difficult.

Ordinary pigments and dyes can be used in the ink composition. Examples are organic dyes or pigments such as those of the azo, phthalocyanine, quinacridone, anthraquinone, dioxazine, and aniline black groups; inorganic pigments such as titanium oxide, cadmium pigments, iron oxide, and chromium oxide; and others such as carbon black and aluminum powder. These pigments and dyes can be used singly or in combinations, or they can be completely omitted.

After the pattern 2 is formed with this ink composition on the paper for decorative use as described hereinbefore, the vehicle resin is hardened. This hardening includes the curing of the thermosetting resin and the baking of the solvent-resistant thermoplastic resin and is differentiated from the ordinary surface film formation of a printing ink due to permeation and drying. The conditions for this hardening vary greatly with the resins. For example: in the case of a thermosetting resin of the condensation type, the conditions are a temperature of 100° to 200° C. and a time of 10 seconds to 10 minutes; in the case of a thermosetting resin of addition polymerization type, the conditions are room temperature to 200° C. and 5 seconds to 15 minutes; and in the case of a solvent-resistant thermoplastic resin, the conditions are 150° to 300° C. and 30 seconds to 30 minutes.

The curing or baking conditions of these resins are known for each of the resins and need not be here described in detail. In any case, this forming of a strong hardened film due to curing or baking at this stage of the process is highly important for maintaining in good state the surface properties such as the releasability of the vehicle resin relative to the thermosetting resin for impregnation and the solvent resistance of the ultimate decorative sheet. The quantity of ink to be applied is preferably in the range of 2 to 200 μm in terms of dry thickness.

The impregnated paper thus obtained by the formation of the pattern 2 and the impregnation with the thermosetting resin is then superposed on the base material 4 as indicated in FIG. 3, and, further, a planar shaping member 5 is superposed thereon. The resulting assembly is then subjected to heating and pressing, whereupon the structure shown in FIG. 4 is obtained. The conditions of the heating and pressing step vary greatly depending on the thermosetting resin selected, but these conditions also are known for the various resins and therefore need not be recited here for each resin. In an embodiment, the temperature is from 100° to 200° C.; the pressure is from 5 to 150 kg/cm$^2$; and the time is from 3 to 60 minutes.

Examples of materials which can be used for the base material 4, are plywoods, particle boards, flexible boards, calcium silicate sheets, and pulp-cement sheets. In addition, other materials such as resin-impregnated, laminated core papers can be used.

For the planar shaping member 5, a plate, sheet, film, or the like of a material which can withstand the heat and pressure conditions required for the curing of the thermosetting resin can be used. Examples of such materials are metals such as duralumins and stainless steels and plastics. Another requirement for this planar shaping member 5 is that its adhesiveness with respect to the still uncured thermosetting resin be greater than that of the vehicle resin of the ink pattern. Still another requirement is that this planar shaping member 5 can be released from thermosetting resin which has been cured. Furthermore, while the surface of this planar shaping member 5 to contact the thermosetting resin 3 is not restricted to only a flat plate surface and may have a surface pattern, this pattern should be of a nature such that it will not impair the releasability of the surface.

Then, as indicated in FIG. 5, pressure is removed while the heating state is maintained, and the planar shaping member 5 is peeled off from the workpiece, whereupon the still uncured parts 3 of the thermosetting resin corresponding to the pattern 2 adhere to the planar shaping member 5, aided by the releasability of the uncured rein relative to the vehicle resin forming the pattern 2. As a result, concavities coinciding with the pattern 2 remain.

As an alternative method, after the heating and pressing, the assembled structure shown in FIG. 4 can also be once cooled while the application of pressure is maintained. Since the still uncured resin parts 3 in this cooled state do not have any adhesiveness even when the planar shaping member 5 is peeled-off from the remainder of the assembled structure, they do not adhere thereto. However, by again heating and pressing at 100° to 200° C. and 5 to 50 kg./cm$^2$, then removing the pressure while the heating is maintained, and peeling off the planar shaping member 5, the still uncured parts 3 adhere to the planar shaping member 5 and are removed, whereby concavities can be formed similarly as described above. By this method, a decrease in the bonding strength between the base material 4 and the decorative paper 1 due to swelling or warping of the base material, which can occur in the case of peeling of the planar shaping member immediately after the heating and pressing, can be prevented.

The decorative sheet A shown in FIG. 5 and obtained in this manner has an exposed pattern 2 as described hereinbefore, but since its vehicle resin is fully hardened, the surface strength is satisfactory as far as this part is concerned.

However, when the movement of the curing inhibitor contained in the pattern 2 is examined a little more microscopically, this inhibitor is diffused not only into the part of the thermosetting layer on the pattern layer but also equally throughout the thermosetting resin with the pattern 2 as a center. For this purpose, the curing inhibitor is distributed with high concentration in the thermosetting resin in the vicinity of the pattern 2 and with low concentration in the thermosetting resin remote from the pattern 2. After the heat and pressure forming, the thermosetting resin at the periphery of the concavities as designated by the reference numeral 7 in FIG. 6 is in an incompletely cured state, and, as mentioned hereinbefore, the product can be unsuitable in some cases as a decorative sheet which is required to have excellent physical and chemical properties.

Figure 6:
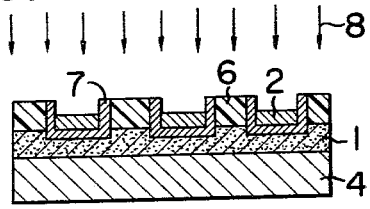
FIG. 6 is a similar sectional view for a description of an after-treatment step carried out as a preferred mode of practice of the invention.

For this reason, in accordance with a preferred mode of practice of this invention, a decorative sheet B as shown in FIG. 6 which has been fully cured and has improved surface physical and chemical properties is produced by irradiating the decorative sheet surface with ultraviolet rays or with electron beam 8 in the case where the impregnating thermosetting resin (3 or 7) is of a radical addition polymerization type, or by reheating the decorative sheet or subjecting the sheet again to heating and pressing in the case where the impregnating thermosetting resin (3 or 7) is of an addition-condensation type.

That complete curing of the incompletely cured thermosetting resin is made possible by irradiation with ultraviolet rays or with electron beam may be attributed to the following principle. The chains of the polymer which has been stabilized with a low molecular weight because of the curing inhibitor are cut by the ultraviolet rays or the electron beam, and radicals are generated. Due to these radicals, further polymerization is initiated and promoted thereby to yield a polymer having a higher molecular weight, and completely cured. Accordingly, in the case where irradiation with ultraviolet rays is to be carried out, the curing can be completed in a shorter time by adding beforehand a substance which generates radicals in response to light, that is, an ultraviolet-ray sensitizer, to the thermosetting resin for impregnation.

For this ultraviolet-ray irradiation, light rays of a wavelength band of the order of 200 nm to 500 nm emitted from a light source such as a low-voltage mercury lamp, a high-voltage mercury lamp, or an ultrahigh-voltage mercury lamp are desirable. For irradiation with electron beam, an irradiation dose of 0.05 to 10 Mrad (megarad) by an accelerated electron beam with an acceleration voltage of 300 to 600 KV and output of 25 to 100 mA is suitable.

Examples of ultraviolet-ray sensitizers which can be added to the thermosetting resin for the purpose of raising the irradiation efficiency of the ultraviolet rays are: benzophenone and its derivatives such as p-chlorobenzophenone and p-benzoylbenzoic acid;

benzoin and its derivatives such as benzoin methyl ether, benzoin ethyl ether and benzoin isobutyl ether;

benzil and its derivatives; and polycyclic quinones such as 1-chloroanthraquinone and 1,4-naphthoquinone. An ultraviolet-ray sensitizer is added in a quantity of 0.5 to 10 percent relative to the thermosetting resin solution for impregnation.

While the exact mechanism of the reaction is not clear, it has been found that heating of the surface to be irradiated to a temperature of 50° to 100° C. immediately prior to irradiation with ultraviolet rays is effective and affords a shortening of the irradiation time. One example of a method of thus heating is that by irradiation with infrared rays, far infrared rays of a wavelength band of 1μ to 25μ being most desirable.

Furthermore, in carrying out irradiation with ultraviolet rays or an electron beam, the irradiation time can be shortened by placing the surface to be irradiated of the decorative sheet in an atmosphere of flowing inert gas such as nitrogen or helium or by tightly covering the surface to be irradiated with an air-excluding shielding film placed in intimate contact with the surface. Examples of suitable films for this purpose are polyester film, polyethylene film, and other transparent or translucent films and, additionally in the case of an electron beam, aluminum foil of a thickness of 20μ to 100μ. This shortening of the irradiation time may be considered to indicate that the radicals generated by the ultraviolet rays or the electron beam are consumed because of the oxygen in air.

In the case where the impregnating thermosetting resin is of the addition-condensation type, condensation and cross-linking reaction is caused to further progress by reheating until complete curing is achieved. As means for this reheating, an ordinary hot-air blower, far infrared-rays of a wavelength band of the order of 1μ to 25μ, or a heat press former can be used. Complete curing can be carried out by reheating at 130° C. to 200° C. for 5 to 30 minutes. A preferable procedure is to apply heat and pressure again under the conditions of 130° C. to 200° C. and 20 kg/cm$^2$ to 100 kg/cm$^2$ by means of a heat press former.

As is apparent from the foregoing description, in the production of decorative sheets having a concavity pattern matching or coincident with a design pattern on a sheet of decorative paper by the process of producing decorative sheets according to this invention, the following features, for example, are afforded.

(1) In the ink pattern above which the concavities are formed the curing inhibitor and the vehicle resin having a releasability with respect to the thermosetting resin are contained, and after the vehicle resin has been hardened, the thermosetting resin is applied for impregnation. For this reason, the thermosetting resin on the pattern cannot be easily cured and, moreover, is very easily removed. Therefore, sharp concavities with sharp edges and steep side walls are formed in close coincidence with the pattern.

(2) Since the vehicle resin in the pattern is solvent resistant and has hardened, the exposed concave parts of the pattern are strong similarly as the convex parts.

(3) Even when, after the planar shaping member has been peeled off, it is used for the succeeding forming cycle without removing the resin adhering thereto, the adhering resin is rendered integral with the thermosetting resin and has no effect on the resulting decorative sheet. Therefore, the adhering resin need not be removed after each cycle of the forming of the decorative sheet, and the decorative sheets can be produced with very high efficiency.

(4) In addition, by irradiating the surface of the decorative sheet after forming under heat and pressure with ultraviolet rays or an electron beam, by reheating the sheet, or by subjecting the sheet a second time to heat and pressure, the peripheral parts of the concavities which are in a not yet fully cured state can be caused to be fully cured. Accordingly, decorative sheets having excellent physical and chemical properties can be produced.

Decorative sheets produced in accordance with the process of this invention as described above are highly suitable for application to a wide range of uses. For example, these decorative sheets can be used as decorative boards for architectural and interior decoration purposes, as doors, wall materials, furniture parts, parts of musical instruments, and parts of kitchens.

In order to indicate more fully the nature and utility of this invention, the following specific examples constituting preferred embodiments of the invention and comparison examples are set forth, it being understood that these examples are presented as illustrative only and that they are not intended to limit the scope of the invention. Throughout the following examples, all quantities expressed in "parts" and "percent" are by weight.

EXAMPLE 1

A wood grain pattern was printed by gravure printing with an ordinary gravure ink on a sheet of titanium paper of 80 g/m$^2$. Then the vessel pattern was printed by means of a gravure printing machine with an ink having a releasability of the following composition.

| Ink composition | |
|---|---|
| silicone resin (dimethyl polysiloxane, condensation type, 50% solid content): (KS-705F, mfd. by Shin-Etsu Kagaku K.K.) | 13 parts |
| cobalt naphthenate: | 0.1 part |
| hydroquinone: | 15 parts |
| pigment, carbon black 3, iron oxide 7 | 10 parts |
| toluene: | 30 parts |
| xylene: | 32 parts |

The paper thus printed was heat treated at 120° C. for 1 minute, and the silicone ink of the vessel pattern was caused to be cured. The paper was then impregnated with 80 g/m$^2$, in terms of solid content, of an impregnating liquor of the following composition.

| Impregnating liquor composition | |
|---|---|
| diallyl phthalate* prepolymer: | 188 parts |
| diallyl phthalate* monomer: | 12 parts |
| benzoyl peroxide: | 12 parts |
| lauric acid: | 0.6 part |
| methyl ethyl ketone: | 150 parts |
| toluene: | 50 parts |

*Hereinafter diallyl phthalate is abbreviated to "DAP".

The impregnating liquor thus applied was dried at 80° C. for 10 minutes, whereupon an impregnated paper was obtained. This paper was next superposed, with its ink surface facing upward, on a sheet of 3-mm plywood. Then, on the paper, a polished duralumin plate was placed with its mirror surface facing downward, and the resulting assembly was pressed for 8 minutes at 140° C. and 10 kg/cm$^2$.

Upon completion of this pressing step, the duralumin plate was peeled off. Then, since the resin part disposed on the vessel pattern lacked affinity with the ink layer forming the vessel parts, and since the resin of these parts was still uncured because of the curing inhibiting effect, the resin parts on only the vessel pattern were transferred onto the duralumin plate, whereupon a decorative sheet having pattern-matched, embossed parts and having sharp edges and steep sidewalls of the embossed parts was obtained.

The front surface of this decorative sheet was irradiated for 20 seconds at an irradiation distance of 10 cm with a high-voltage mercury lamp (output 80 W/cm.×75 mm) (HI-6A, mfd. by Nippon Denchi K.K.), whereupon a decorative sheet with even greater resistance to scoring and other surface damage was obtained.

EXAMPLE 2

A wood grain pattern was printed by gravure printing with an ordinary gravure ink on a sheet of titanium paper of 80 g/m$^2$. Then the vessel pattern was printed by means of a gravure printing machine with an ink having a releasability of the following composition.

| Ink composition | |
|---|---|
| fluororesin (polyvinylidene fluoride, 50% solid content): (Fukkaron 3000, mfd. by Kansai Paint K.K.) | 15 parts |
| hydroquinone: | 23 parts |
| pigment, benzidine yellow: | 5 parts |
| ferric oxide: | 4 parts |
| solvent, dimethylacetamide: | 40 parts |
| dipentaerythritol: | 0.1 part |
| isophorone: | 10 parts |

The paper thus printed was heat treated at 200° C. for 1 minute, and the ink of the vessel parts was caused to harden. The paper was then impregnated with 80 g/m$^2$, in terms of solid content, of an impregnating liquor of the following composition.

| Impregnating liquor composition | |
|---|---|
| DAP prepolymer: | 188 parts |
| DAP monomer: | 12 parts |
| benzoyl peroxide: | 12 parts |
| lauric acid: | 0.6 part |
| methyl ethyl ketone: | 150 parts |
| toluene: | 50 parts |

-continued

| Impregnating liquor composition | |
|---|---|
| benzyl: | 10 parts |

The impregnating liquor thus applied was dried at 80° C. for 10 minutes, whereupon an impregnated paper was obtained. This paper was next superposed, with its ink surface facing upward, on a sheet of 3-mm plywood. Then, on the paper, a polished duralumin plate was placed with its mirror surface facing downward, and the resulting assembly was pressed for 8 minutes at 140° C. and 10 kg/cm$^2$.

Upon completion of this pressing step, the duralumin plate was peeled off. Then, the resin parts on only the vessel pattern were transferred onto the duralumin plate, whereupon the same decorative sheet as in Example 1 was obtained.

The front surface of this decorative sheet was irradiated for 50 seconds at an irradiation distance of 15 cm with a high-voltage mercury lamp (30 W/cm×700 mm) (H 2000L, mfd. by Toshiba K.K.) whereupon a decorative sheet having further improved surface properties was obtained.

The sheet showed differences in properties before and after the ultraviolet radiation as tabulated below:

Table

| Surface Property Test Item | Ultraviolet Radiation: Before radiation | Ultraviolet Radiation: After radiation |
|---|---|---|
| 1. Solvent resistance (Drop Test)*1 | | |
| toluene | o | o |
| isopropyl alcohol | o | o |
| methylethyl ketone | Δ | o |
| chloroform | o | o |
| 2. Wear resistance (NEMA-Taber Method)*2 (JAS F W Test) | | |
| . Wear value (times) | 250 | 275 |
| . Rate of Wear per 100 cycles | 0.075 | 0.07 |
| 3. Susceptibility to fingernail scratches*3 | Δ | o |

Notes:

*1 A few droplets of the individual solvents listed were dropped onto the surface of the decorative sheet, and covered with a small receptacle. After evaporation of the solvents, the surface of the sheet was examined with the naked eye particularly for "stains". As a result, all the ink parts were found stainless, but their peripheral regions were in the following state:

o : No stain was left.

Δ : A few stains were found in some cases.

x : Stains were left.

*2 A test carried out with a Taber abraser in accordance with NEMA No.LP 2-1963, Part 6: Hard-board Core Type Decorative Laminates. The abrasion wheel used was C.S.17 and the loading was 500 g. The wear value indicates the number of revolutions (average of the values obtained from the tests repeated three times) at which a half (in area) of the pattern faded away, and the rate of wear per 100 cycles shows an abrasion loss obtained from the following formula based on the wear value:

$$\frac{\text{Weight loss at endpoint}}{\text{Wear value}} \times 100$$

*3 Susceptibility to scratches observed when the decorative sheet was scratched with a fingernail.

o : No scratch was left.

Δ : Some scratches were left but could not readily be detected by the naked eye.

EXAMPLE 3

A wood grain pattern was printed by gravure printing with an ordinary gravure ink on a sheet of titanium paper of 55 g/m$^2$. When the vessel pattern was printed by means of a gravure printing machine with the same ink as in Example 1.

The paper thus printed was heat treated at 120° C. for 1 minute to cause the ink of the vessel parts to be cured. The paper was then impregnated with 55 g/m$^2$, in terms of solid content, of the same impregnation resin solution as in Example 1. The impregnation solution was dried at 80° C. for 10 minutes, whereupon an impregnated paper was obtained.

Subsequently, this paper was superposed on a sheet of 4-mm plywood and a vinylon film was placed on the paper. The assembly was pressed under heat under the same conditions as in Example 1. When the vinylon film was peeled off, the resin on the vessel pattern was transferred onto the vinylon film, whereupon an embossed decorative sheet with concavities completely coincident with the pattern was obtained.

This decorative sheet was irradiated with far infrared rays (10 W/cm) (Infrajet, Jard) for 20 seconds at an irradiation distance of 20 cm and then with a high-voltage mercury lamp (30 W/cm×700 mm) (H 2000L, Toshiba) for 30 seconds at an irradiation distance of 15 cm, whereupon a decorative sheet having very excellent surface properties was obtained.

For purposes of comparison, the sheet was not irradiated with far infrared rays but irradiated with only a high-voltage mercury lamp. In this case, 60-second irradiation was required to obtain the same properties.

EXAMPLE 4

A wood grain pattern was printed by gravure printing with an ordinary gravure ink on a sheet of titanium paper of 80 g/m$^2$. Then the vessel pattern was printed by means of a gravure printing machine with an ink of the following composition.

| Ink composition | |
|---|---|
| fluororesin (polyvinylidene fluoride, Fukkaron 3000, mfd. by Kansai Paint K.K.): | 15 parts |
| hydroquinone: | 23 parts |
| pigment, ferric oxide: | 10 parts |
| solvent, dimethylacetamide: | 40 parts |
| dipentaerythritol: | 0.1 part |
| isophorone: | 10 parts |

The paper thus printed was heat treated at 200° C. for 1 minute to cause the ink to be cured. The paper was then impregnated with 96 g/m$^2$, in terms of solid content, of an impregnating liquor of the following composition.

| Impregnating liquor composition | |
|---|---|
| DAP prepolymer: | 120 parts |
| unsaturated polyester resin: (ALLYLAX DH2000G, mfd. by Mitsubishi Gas Kagaku K.K.) | 40 parts |
| benzoyl peroxide: | 12 parts |
| lauric acid: | 0.6 part |
| methyl ethyl ketone: | 150 parts |
| toluene: | 50 parts |

The impregnating solution thus applied was dried at 80° C. for 10 minutes, whereupon an impregnated paper was obtained. This paper was superposed, with its ink surface facing upward, on a sheet of 3-mm plywood. Then, on the paper, a duralumin plate was placed with its 20% mat surface facing downward, and the assembly was pressed under heat under the same conditions as in Example 1.

Upon completion of the pressing step, the duralumin plate was peeled off, and the same decorative sheet as in Example 1 was obtained.

This decorative sheet was irradiated in a nitrogen gas stream with electron beams of an acceleration voltage of 300 KV in a dose of 0.2×10$^6$ rad, whereupon a decorative sheet having very excellent properties was obtained.

EXAMPLE 5

A wood grain pattern was printed by gravure printing with an ordinary gravure ink on a sheet of titanium paper of 80 g/m$^2$. Then, the vessel pattern was printed by means of a gravure printing machine with an ink having a releasability of the following composition.

| Ink composition | |
|---|---|
| melamine resin (trimethylolmelamine): | 5 parts |
| cellulose acetate propionate: | 5 parts |
| p-toluenesolfonic acid: | 0.2 part |
| pigment (aniline black): | 20 parts |
| hydroquinone: | 20 parts |
| ethyl acetate/toluene/isopropyl alcohol (10/25/15): | 50 parts |

The paper thus printed was dried at 150° C. for 1 minute to cause the ink of the vessel parts to be cured. The paper was then impregnated with 50 g/m$^2$, in terms of solid content, of an impregnating liquor of the following composition.

| Impregnating liquor compositon | |
|---|---|
| DAP prepolymer: | 188 parts |
| DAP monomer: | 12 parts |
| benzoyl peroxide: | 12 parts |
| lauric acid: | 0.6 part |
| methyl ethyl ketone: | 150 parts |
| toluene: | 50 parts |

The impregnating liquor thus applied was dried at 80° C. for 10 minutes, whereupon an impregnated paper was obtained. This paper was then superposed, with its ink surface facing upward, on a sheet of 3-mm plywood. Further, on the paper, a polypropylene film was placed, and the entire assembly was pressed for 8 minutes at 140° C. and 10 kg/cm$^2$.

Upon completion of this pressing step, the polypropylene film was peeled off. Then, the resin parts on the vessel parts, being lacking in affinity with the ink layer forming the vessel pattern and being still uncured because of the setting inhibiting effect, was transferred onto the polypropylene film, whereupon the same decorative sheet as in Example 1 was obtained.

The front surface of this decorative sheet was irradiated with electron beams of an acceleration voltage of 500 KV in a dose of 1.0×10$^6$ rad, whereupon a decorative sheet which stood the test in accordance with MEMA No. LP 2-1961, Part 6: Hardboard-Core-Type Decorative Laminates was obtained.

EXAMPLE 6

A paper printed in the same manner as in Example 1 was heat treated under the same conditions to cause the silicone ink forming the vessel pattern to be cured. The paper was then impregnated with 80 g/m$^2$, in terms of solid content, of an impregnating liquor of the following composition.

| Impregnating liquor composition | |
|---|---|
| DAP prepolymer: | 120 parts |
| unsaturated polyester: (ALLYLAX DH2000G, mfd. by Mitsubishi Gas | 40 parts |

-continued

| Impregnating liquor composition | |
|---|---|
| Kagaku K.K.) | |
| benzoyl peroxide: | 12 parts |
| lauric acid: | 0.6 part |
| microsilica (Siloid of average particle size of 3.3μm, #244, Fuji-Davison Company): | 10 parts |
| acetone: | 150 parts |
| toluene: | 50 parts |

The impregnating liquor thus applied was dried at 80° C. for 10 minutes, whereupon an impregnated paper was obtained. Then, press forming was carried out under the same conditions as in Example 1.

Upon completion of the pressing step, the duralumin plate was separated. The uncured DAP resin on the ink portion forming the vessel pattern adhered to the duralumin plate, whereupon a decorative sheet with very stable embossed parts having sharp edges was obtained.

The uncured DAP resin readily adhered to the duralumin plate presumably because the microsilica added to the impregnating liquor served to reduce the cohesive force of the uncured DAP resin, and at the same time the adhesion between-the microsilica and the duralumin plate occurred.

EXAMPLE 7

Printing and impregnation were carried out in exactly the same manner as in Example 1, and then heating and pressing were applied under the same conditions.

Subsequently, the press was cooled with water to room temperature while maintaining the pressure as it was, and thereafter the pressure was released. When the duralumin plate was peeled off, no resin adhered to the plate.

The decorative sheet obtained was again placed under the duralumin plate, and both were pressed for 2 minutes at 140° C. and 5 kg/cm$^2$. Then, the pressure was released while the assembly was maintained under heat, whereupon the resin adhered to the duralumin plate as in Example 1.

COMPARISON EXAMPLE 1

A wood grain pattern was printed by gravure printing with an ordinary gravure ink on a sheet of titanium paper of 80 g/m$^2$. Then, the vessel pattern was printed by means of a gravure printing machine with the same ink as in Example 1 except that hydroquinone was omitted.

The paper thus printed was heat treated, impregnated and press formed under the same conditions as in Example 1.

Upon completion of the pressing step, the duralumin plate was separated. No resin adhered to the plate, and only an ordinary flat DAP decorative sheet was obtained. This may be because the mere addition of a resin having releasability to the ink is not sufficient to reduce the cohesive force of the DAP resin to such an extent that the resin adheres to the duralumin plate.

COMPARISON EXAMPLE 2

A wood grain pattern was printed by gravure process with an ordinary gravure ink on a sheet of titanium paper of 80 g/m$^2$ weight. Then the vessel pattern was printed by means of a gravure printing machine with an ink prepared by substituting 13 parts of cellulose acetate for the silicone resin and cobalt naphthenate in the ink of Example 1. The paper thus printed was dried at 80° C. for 5 seconds.

The printed paper thus dried was impregnated with the same resin solution under the same conditions as in Example 1 and forming was carried out also under the same conditions.

Upon completion of the pressing step, the duralumin plate was separated off, but the still uncured resin to be removed could not be thoroughly taken off, only one part thereof adhering to the duralumin plate. As a result, an embossed decorative sheet having shallow concavities with irregularities was obtained.

The reason for this result may be attributed to the following causes.

1. Since the ink was not heat treated, a film having solvent resistance was not formed, and, at the time of imprgnation with the DAP resin, hydroquinone underwent elution in the DAP resin solution, whereby the quantity of hydroquinone in the ink decreased.

2. The releasability of the cellulose resin film with respect to the DAP resin was low, and instead the adhesiveness to the uncured DAP resin was high. For this reason, the still uncured DAP resin could not easily accompany the duralumin plate.

Furthermore, a solvent resistance test was carried out by using a methylethyl ketone (MEK) similarly as in the above Example 2, whereupon the resin in the peripheral parts of the ink dissolved and stains were caused. In addition, the ink, itself, was completely dissolved, and the pattern disappeared.

COMPARISON EXAMPLE 3

The same paper as in Example 1 was printed with the same ink to prepare a decorative paper. This paper was not heat treated but was directly impregnated with the same resin as in Example 1, and forming under heat and pressure was carried out under the same conditions as in Example 1.

Upon completion of the pressing step, the duralumin plate was separated off, whereupon it was found that the quantity of resin adhering to the duralumin plate was small. Moreover sharp edges of the concavities were not obtained.

Methylethyl ketone was applied by dropping on the outer surface of the above described decorative sheet similarly as in Example 2, whereupon not only the DAP resin parts surrounding the concavities but also the ink forming vessel pattern in the concavities completely dissolved, and the pattern disappeared.

The failure to obtain concavities with sharp edges may be attributed to the following two reasons.

(1) Since heat treatment of the ink was not carried out, the hydroquinone dissolved into the solvent of the impregnating solution at the time of resin impregnation. For this reason, the setting inhibitor dissolved and diffused.

(2) Since heat treatment of the ink was not carried out, the releasability of the vehicle resin of the ink had deteriorated.

Furthermore, the reason for the deterioration of the solvent resistance is that, since heat treatment of the ink was not carried out, the resin diluted or eluted by the solvent at the succeeding time of impregnation, and under the conditions of the subsequent forming under heat and pressure, also, a hardened film of sufficient solvent resistance had not been formed.

What we claim is:

1. A process for producing decorative sheets having a thermosetting resin surface, which process includes in sequence (1) forming a pattern on a paper for decorative use with an ink containing a vehicle resin and a curing inhibitor for a thermosetting resin;

(2) impregnating the entire paper for decorative use including the pattern with said thermosetting resin to form an impregnated paper wherein a film of still uncured thermosetting resin is formed over the pattern;

(3) assembling a laminated structure by so superposing the impregnated paper on a base material that the surface of the paper bearing the pattern will become the outer surface and further placing a planar shaping member on the paper;

(4) subjecting the laminated structure to heating and pressing to cause the thermosetting resin at parts not contacted by the curing inhibitor in the pattern to cure, leaving the thermosetting resin contacted by the curing inhibitor in the pattern in still uncured state; and (5) peeling off the planar shaping member, under heat and after the termination of the pressing, thereby to form concavities in the film of the thermosetting resin by removing at least some of the still uncured resin due to adhesion of the uncured resin to the planar shaping member thus peeled-off, wherein the improvement comprises:

selecting for the vehicle resin in the ink a resin having releasability from the thermosetting resin and, prior to step (2), causing the vehicle resin in the pattern formed in step (1) to harden, whereby the still uncured resin after step (4) is substantially restricted to the parts of the thermosetting resin directly over the pattern, and in step (5) substantially all of said uncured resin is released from the hardened vehicle resin and adheres to the planar shaping member.

2. A process for producing decorative sheets as claimed in claim 1 in which the thermosetting resin is caused to impregnate the paper for decorative use in a quantity of 30 to 200 percent, in terms of solid content, of the weight of said paper.

3. A process for producing decorative sheets as claimed in claim 1 in which the ink comprises 5 to 50 percent of a vehicle resin, 20 to 70 percent of a solvent, 3 to 60 percent of a curing inhibitor, and 0 to 50 percent of a pigment, all percentages being by weight.

4. A process for producing decorative sheets as claimed in claim 1 in which the ink is used in a quantity such that it will have a thickness of 2 to 200 μm upon being dried.

5. A process for producing decorative sheets as claimed in claim 1 in which the planar shaping member is a structure selected from the group consisting of plates, sheets, and films of metals and plastics.

6. A process for producing decorative sheets as claimed in claim 1 which further comprises, prior to process step (1), a process step of providing a base pattern on the paper for decorative use.

7. A process for producing decorative sheets as claimed in claim 1 further comprising, prior to process step (5), a process step of once cooling the laminated structure obtained in process step (4) in the as-pressed state and then reheating and pressing the laminated structure.

8. A process for producing decorative sheets as claimed in claim 1 in which the thermosetting resin is used for impregnation in the form of an impregnating liquor comprising 20 to 70 percent by weight of the thermosetting resin, 30 to 70 percent by weight of a solvent, and 1 to 5 percent by weight of a curing promotor.

9. A process for producing decorative sheets as claimed in claim 8 in which the impregnating liquor containing the thermosetting resin for impregnation and the solvent further comprises 1 to 6 percent by weight thereof of an inorganic power which is incompatible with both the thermosetting resin and the solvent.

10. A process for producing decorative sheets as claimed in claim 1 in which the vehicle resin in the ink is a solvent-resistant thermoplastic resin.

11. A process for producing decorative sheets as claimed in claim 10 in which the thermoplastic resin is a fluorine-containing resin.

12. A process for producing decorative sheets as claimed in claim 1 in which the thermosetting resin for impregnation comprises an addition-condensation type thermosetting resin.

13. A process for producing decorative sheets as claimed in claim 12 in which the addition-condensation type thermosetting resin is at least one resin selected from the group consisting of melamine resins, urea resins, acetoguanamine resins, and benzoguanamine resins.

14. A process for producing decorative sheets as claimed in claim 12 in which the vehicle resin in the ink is a thermosetting resin of addition polymerization type.

15. A process for producing decorative sheets as claimed in claim 14 in which the thermosetting resin is a resin selected from the group consisting of diallyl phthalate resins, unsaturated polyester resins, urethane resins, epoxy resins of amine-cure types, and silicone resins of addition polymerization type.

16. A process for producing decorative sheets as claimed in claim 12 in which the curing inhibitor in the ink is a member selected from the group consisting of hydroxides of alkali metals, hydroxides of alkaline earth metals, and oxides of alkaline earth metals.

17. A process for producing decorative sheets as claimed in claim 16 in which the curing inhibitor is a member selected from the group consisting of sodium hydroxide, potassium hydroxide, calcium hydroxide, and calcium oxide.

18. A process for producing decorative sheets as claimed in claim 16 in which the curing inhibitor is used in conjunction with a blowing agent selected from the group consisting of sodium hydrogencarbonate, sodium borohydride, azobisisobutyronitrile, benzenesulfonyl hydrazide, and p-toluenesulfonyl hydrazide.

19. A process for producing decorative sheets as claimed in claim 12 which further comprises a process step of reheating the decorative sheet obtained after process step (5) thereby to cause the thermosetting resin at the peripheries of the concavities to be fully cured.

20. A process for producing decorative sheets as claimed in claim 19 in which the reheating step is carried out with the decorative sheet in a pressed state.

21. A process for producing decorative sheets as claimed in claim 1 in which the thermosetting resin for impregnation comprises a thermosetting resin of radical addition polymerization type.

22. A process for producing decorative sheets as claimed in claim 21 in which the thermosetting resin of radical addition polymerization type is at least one resin selected from the group consisting of diallyl phthalate resin and unsaturated polyester resins.

23. A process for producing decorative sheets as claimed in claim 21 in which the vehicle resin in the ink comprises a thermosetting resin of condensation type.

24. A process for producing decorative sheets as claimed in claim 23 in which the thermosetting resin is a resin selected from the group consisting of melamine resins, urea resins, silicone resins, phenolic resins, and epoxy resins.

25. A process for producing decorative sheets as claimed in claim 21 in which the curing inhibitor in the ink is a radical addition polymerization inhibitor.

26. A process for producing decorative sheets as claimed in claim 25 in which the curing inhibitor is a member selected from the group consisting of p-benzoquinone, naphthoquinone, hydroquinone, methoquinone, methylhydroquinone, p-tert-butyl catechol, ditertiary butyl paracresol, hydroquinone monomethyl ether, copper naphthenate, phenylhydrazine hydrochloride, and trimethylbenzylammonium chloride.

27. A process for producing decorative sheets as claimed in claim 21 which further comprises, after process step (5), a process step of irradiating the decorative outer surface having concavities with radiation rays selected from ultraviolet rays and electron beams thereby to cause the thermosetting resin at the peripheries of the concavities to be fully cured.

28. A process for producing decorative sheets as claimed in claim 27 in which the decorative outer surface is thus irradiated in an inert gas atmosphere.

29. A process for producing decorative sheets as claimed in claim 27 in which the decorative outer surface is thus irradiated in a state wherein it is covered by an intimately adhering film which transmits the radiation rays but shields out air.

30. A process for producing decorative sheets as claimed in claim 27 in which an ultraviolet-ray sensitizer is added beforehand to the thermosetting resin for impregnation, and the decorative outer surface is irradiated with ultraviolet rays as the radiation rays.

31. A process for producing decorative sheets as claimed in claim 27 in which ultraviolet rays are used as the radiation rays, and the decorative outer surface is heated after process step (5) and prior to the irradiation with ultraviolet rays.

32. A process for producing decorative sheets as claimed in claim 31 in which the decorative outer surface is heated by irradiation thereof with infrared rays.

* * * * *